US006418742B1

(12) United States Patent
Chaney

(10) Patent No.: US 6,418,742 B1
(45) Date of Patent: Jul. 16, 2002

(54) REMOVABLE RESERVOIR COOLER

(75) Inventor: David B. Chaney, Westerville, OH (US)

(73) Assignee: Oasis Corporation, Columbus, OH (US)

( * ) Notice: Subject to any disclaimer, the term of this patent is extended or adjusted under 35 U.S.C. 154(b) by 0 days.

(21) Appl. No.: 09/955,727

(22) Filed: Sep. 18, 2001

Related U.S. Application Data

(60) Provisional application No. 60/235,508, filed on Sep. 26, 2000.

(51) Int. Cl.[7] ..... F25D 15/00

(52) U.S. Cl. ..... 62/237; 62/391; 62/389; 62/393

(58) Field of Search ..... 62/391, 389, 393, 62/237

(56) References Cited

U.S. PATENT DOCUMENTS 5,003,790 A * 4/1991 Goupil ..... 62/389
5,289,951 A 3/1994 Burrows
5,297,700 A 3/1994 Burrows et al.
5,413,152 A 5/1995 Burrows
5,553,935 A * 9/1996 Burnham et al. ..... 312/265.3
5,647,416 A * 7/1997 Desrosiers et al. ..... 141/351
5,667,103 A * 9/1997 Donselman et al. ..... 222/129
5,730,863 A * 3/1998 Howlings et al. ..... 210/109
6,062,255 A 5/2000 Busick
6,085,540 A * 7/2000 Davis ..... 62/389
6,112,541 A * 9/2000 Greene ..... 62/389
6,119,462 A * 9/2000 Busick et al. ..... 62/3.64
6,167,921 B1 1/2001 Busick et al.
6,207,046 B1 * 3/2001 Yamashita et al. ..... 210/138
6,237,345 B1 * 5/2001 Kalman et al. ..... 62/3.64

* cited by examiner

*Primary Examiner*—William C. Doerrler
*Assistant Examiner*—Mark Shulman
(74) *Attorney, Agent, or Firm*—Kelly Bauersfeld Lowry & Kelley, LLP

(57) ABSTRACT

A water cooler is provided with a removable reservoir separable from a cooler housing and transportable as a portable unit to a different location for remote dispensing of chilled water or other selected beverage. The removable reservoir comprises an insulated vessel having a dispensing faucet and adapted for removable mounting onto the cooler housing in thermal communication with a chiller element for maintaining the water within the reservoir in a chilled condition. The insulated reservoir is designed for quick and easy lift-off removal from the cooler housing and may include a convenient carrying handle to facilitate transport thereof to a remote location. In one preferred form, the removable reservoir supports an inverted water supply bottle for replenishing dispensed water, whereas in another preferred form the removable reservoir is adapted for receiving water inflow from a filtered tap water source or the like.

31 Claims, 10 Drawing Sheets

REMOVABLE RESERVOIR COOLER

This application claims the benefit of Provisional Application No. 60/235,508, filed Sep. 26, 2000.

BACKGROUND OF THE INVENTION

This invention relates generally to improvements in water coolers of the type having a water reservoir for receiving and storing a supply of relatively purified water or the like, and for selectively dispensing the water from the reservoir. More particularly, this invention relates to an improved water cooler wherein the reservoir is quickly and easily removable from a water cooler housing, and transportable as a portable unit to a location remote from the cooler housing for use in remote dispensing of chilled water or other selected beverage.

Bottled water coolers are generally well-known in the art for containing a supply of relatively purified water in a convenient manner and location ready for substantially immediate dispensing and use. Such bottled water coolers commonly comprise an upwardly open water reservoir mounted within a cooler housing and adapted to receive and support an inverted water bottle of typically three to five gallon capacity. Water within the inverted bottle flows downwardly to fill the cooler reservoir within which the water is commonly chilled by appropriate refrigeration means to a selected and refreshing temperature. The water within the reservoir is dispensed for use through a faucet valve located typically on the front of the cooler housing. When the inverted bottle reaches an empty condition, the empty bottle is removed from the cooler and a filled replacement bottle is installed onto the cooler in an inverted orientation. Such bottled water coolers are widely used to provide a clean and safe source of water for drinking and cooking, especially in areas where the local water supply contains or is suspected to contain undesired levels of contaminants.

In some water cooler designs, water is supplied to the cooler reservoir from a source other than a removable inverted water bottle In one configuration, the cooler reservoir is coupled to an incoming tap water supply from which contaminants are removed by appropriate purification devices such as a reverse osmosis purification unit. Alternately, or in addition, one or more filtration units including carbon and/or other suitable filtration media may be used to produce relatively purified water delivered to the cooler reservoir for dispensing on demand.

Bottled water coolers of the above-described types, however, are not portable in nature. That is, the cooler housing and the associated refrigeration and/or purification/filtration means are not readily and conveniently transportable from one location to another for use in on-demand dispensing of clean chilled water or the like at different sites. Instead, when the bottled water cooler is set up and operating at a particular installation site, it has been necessary for individuals to be located at the site of cooler installation in order to access the water or other selected beverage contained therein.

The present invention relates to an improved water cooler of the general type described above, but wherein the cooler reservoir is designed for quick and easy separation from the cooler housing and is transportable as a unit to a different location whereat the water contained therein can be dispensed for use.

SUMMARY OF THE INVENTION

In accordance with the invention, an improved water cooler is provided with a removable reservoir which can be separated from a cooler housing and transported as a portable unit to a location remote from the cooler housing for use in remote dispensing of chilled water or other selected beverage. The removable reservoir comprises an insulated vessel to maintain the water therein in a desired chilled condition for a substantial period of time following separation from the cooler housing. Upon completion of reservoir usage at the remote location, the cooler reservoir is designed for quick and easy re-installation onto the cooler housing for resumed normal use.

The removable reservoir is adapted for normal and removable mounting onto the cooler housing in thermal communication with a chiller element for maintaining the water or other selected beverage within the reservoir in a chilled condition. The insulated reservoir is further equipped with a dispensing faucet for beverage dispensing. The reservoir is designed for quick and easy lift-off separation from the cooler housing and may include a convenient carrying handle to facilitate transport thereof to an alternative location remote from the cooler housing. In one preferred form, the removable reservoir is adapted for normally supporting an inverted water supply bottle for replenishing the reservoir as water is dispensed therefrom. In another preferred form, the removable reservoir is adapted for receiving water inflow from a tap water source or the like, and may include a filter unit for purifying water added to the reservoir.

In a preferred configuration, the removable reservoir includes a generally cup-shaped mounting sleeve formed in a bottom wall thereof in a downwardly open position for slide-fit reception of an upstanding chiller probe when the reservoir is normally installed onto the cooler housing. The chiller probe comprises a portion of a refrigeration system for chilling the water or the like within the reservoir. Upon lift-off separation of the removable reservoir from the cooler housing, a portable refrigeration unit such as a re-usable and freezable packaged chiller media of the type marketed by Rubbermaid, Inc. of Wooster, Ohio under the trade name Blue Ice can be seated within the mounting sleeve to maintain the reservoir contents in a chilled condition.

Other features and advantages of the present invention will be more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
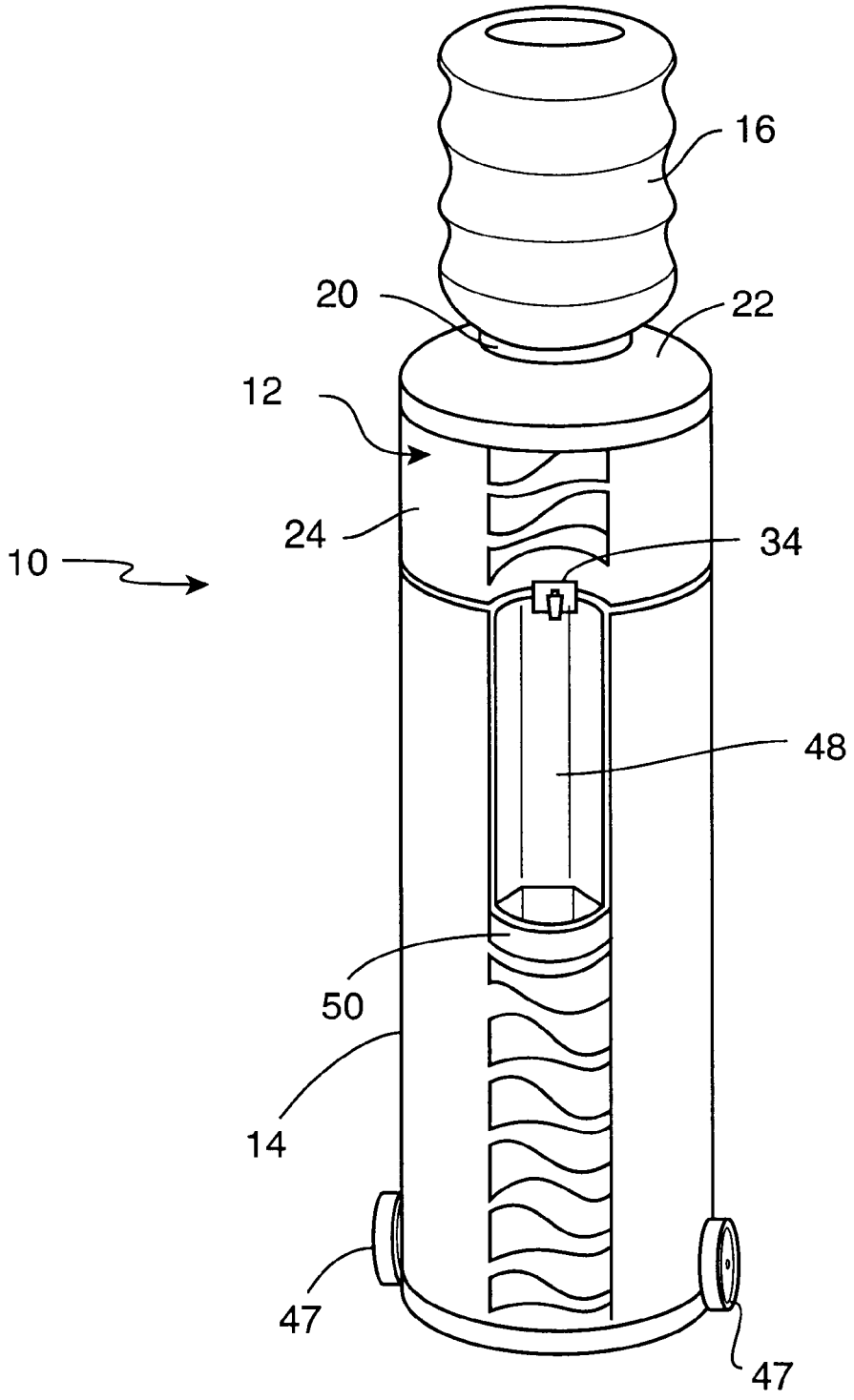
FIG. 1 is a perspective view illustrating a bottled water cooler equipped with a removable reservoir in one preferred form, in accordance with the novel features of the invention.
Figure 4:
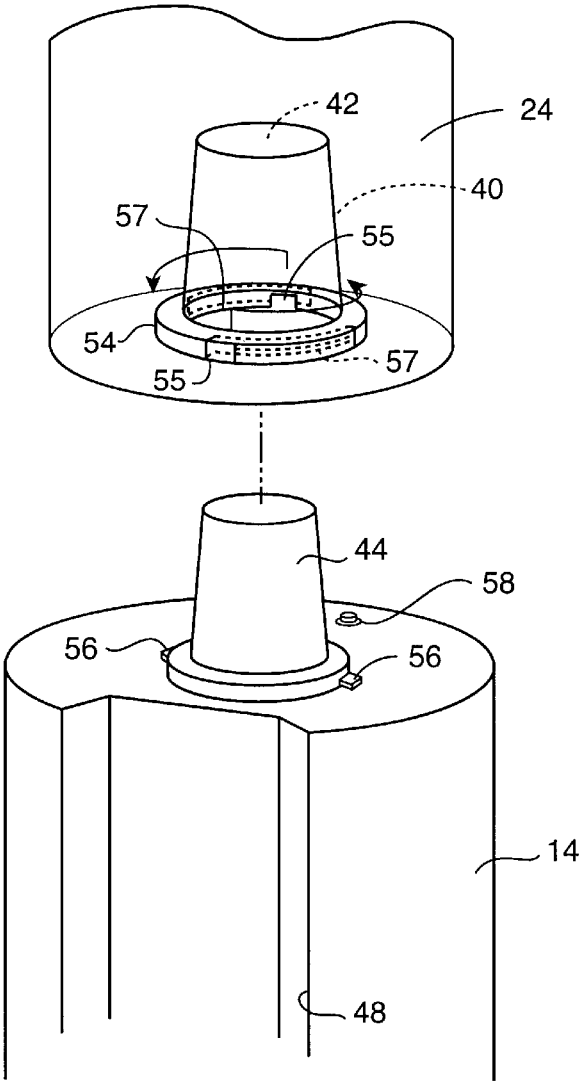
FIG. 4 is an exploded and fragmented perspective view illustrating removable locked mounting of the removable reservoir onto the cooler housing.

As shown in the exemplary drawings, an improved water cooler referred to generally by the reference numeral 10 in FIG. 1 comprises a removable reservoir 12 mounted onto the upper end of a cooler housing 14. In accordance with the invention, the removable reservoir 12 is designed for quick and easy lift-off separation from the underlying cooler housing 14 (as viewed best in FIG. 4) to provide a compact and portable insulated vessel which can be transported to a remote site for dispensing water or the like. At the conclusion of such remote dispensing usage, the reservoir 12 can be returned to and reinstalled quickly upon the cooler housing 14 for resumed; normal use.

Figure 2:
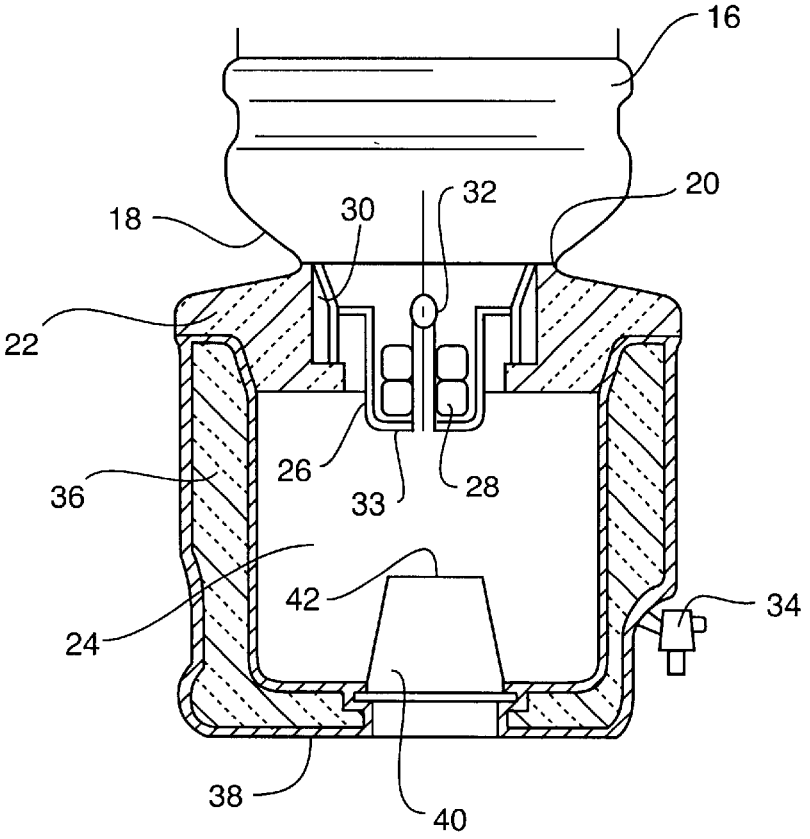
FIG. 2 is an enlarged fragmented and somewhat diagrammatic sectional view of an upper portion of the bottled water cooler of FIG. 1.
Figure 3:
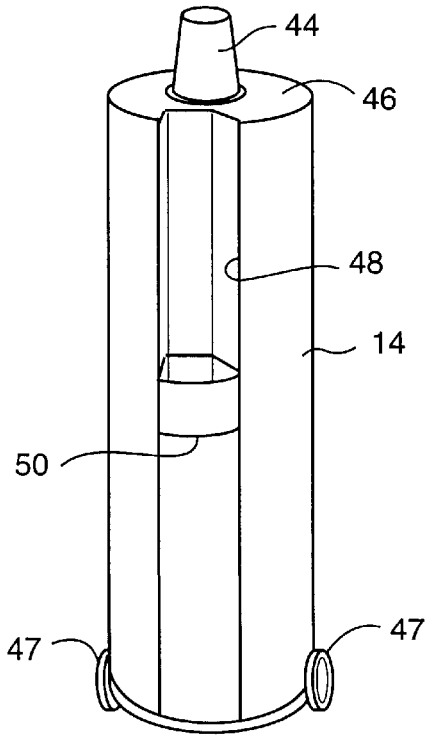
FIG. 3 is a perspective view showing a lower cooler housing of the bottled water cooler of FIG. 1, with the reservoir removed therefrom.

The illustrative water cooler 10 is shown in FIGS. 1–3 in the form of a bottled water cooler wherein water is supplied to hollow interior of the reservoir 12 from a water bottle 16 supported thereon in an inverted orientation. As shown best in FIG. 2, the inverted water bottle 16 has a downwardly presented shoulder 18 supported on an upper rim 20 of an annular lid member 22 mounted over the upper end of a generally cylindrical and upwardly open vessel 24. A neck 26 of the inverted water bottle 16 is shown fitted into a mounting adapter 28 suitably supported within a central opening 30 of the lid member 22, wherein this mounting adapter includes a feed tube 32 designed to engage and open a valved cap 33 on the bottle neck 26 to permit water downflow from the bottle 16 into a hollow interior chamber formed within the reservoir or vessel 24. The mounting adapter 28 corresponds with the mounting adapter disclosed in copending U.S. Ser. No. 09/406,210, now U.S. Pat. No. 6,167,921, or alternately with the mounting adapter shown and described in U.S. Pat. No. 5,413,152, both or which are incorporated by reference herein. Such mounting adapters are marketed by Oasis Corporation of Columbus, Ohio under the name WaterGuard.

A manually operated dispensing faucet 34 is mounted onto the vessel 24 in flow communication with the hollow interior thereof, for dispensing water from the vessel 24 when desired for drinking, cooking, etc. In this regard, water from within the water bottle 16 will flow downwardly through the mounting adapter 28 until the water level within the vessel 24 rises sufficiently to block or cover the downwardly open bottle neck 26. When this occurs, water downflow from the inverted bottle 16 is halted. Dispensing of water from the vessel 24 via the faucet 34 lowers the water level within the vessel 24, ultimately to a level unblocking or uncovering the downwardly open bottle neck 26, resulting in resumed water downflow from. the bottle 16 until the water level rises sufficiently to re-cover the bottle neck. When the overlying water bottle eventually reaches an empty condition, the empty bottle is removed and replaced with a filled bottle.

The vessel 24 and the lid member 22 mounted thereon cooperatively define the removable reservoir 12 of the present invention. In this regard, both the vessel 24 and the lid member 22 are shown to include hollowed wall cavities filled with a suitable insulation material 36 (FIG. 2) for purposes of maintaining the temperature level of the water contained therein. In addition, as shown best in FIG. 2, a bottom wall 38 of the vessel 24 includes a centrally positioned inverted cup-shaped mounting sleeve 40 extending upwardly into the hollow vessel interior and terminating in a closed upper end wall 42. This mounting sleeve 40 is sized and shaped, typically to include a tapered and truncated conical geometry, for snug and substantially mated or intimate surface-to-surface fit onto an upstanding probe-shaped chiller element or probe 44 (FIG. 3) protruding upwardly from an upper support wall or platform 46 of the cooler housing 14 (FIG. 3). This chiller element 44 provides, as will be described in more detail, a refrigeration source for chilling water within the vessel 24 to a selected and refreshing temperature. In this regard, as viewed in FIG. 2, the cup-shaped mounting sleeve 40 is not filled or lined with the insulation material 36.

In normal operation, the vessel 24 is seated upon the upper support wall 46 of the cooler housing 14, with the chiller element 44 seated snugly into the mounting sleeve 40 at the bottom of the removable reservoir 12. Desirably, the exterior surfaces of the overlying reservoir 12 and the underlying housing 14 have a conforming size and shape to provide the overall cooler 10 with an attractive external appearance, such as an upright cylindrical shape which may include decorative embossing as shown or other external surface design elements (as viewed in FIG. 1). The cooler housing 14 may additionally include wheels 47 at a base end thereof for facilitated cooler movement. The dispensing faucet 34 carried by the vessel 24 is conveniently positioned in alignment with a vertically extending external cavity 48 formed in a front of the cooler housing 14, wherein a drip tray 50 is supported at a lower end of this vertical cavity 48. A refrigeration unit 52 (FIG. 9), such as a traditional mechanical refrigeration unit or a compact thermoelectric refrigeration unit, is mounted within the cooler housing 14 and provides a means for refrigerating the chiller element 44, and for correspondingly chilling the water within the removable reservoir 12. Construction and design details of the refrigeration unit 52 and the associated chiller element 44, in accordance with one preferred form, are shown and described in U.S. Pat. Nos. 5,289,951 and 5,297,700, which are incorporated by reference herein.

The removable reservoir 12 is desirably locked by releasible lock means onto the upper end of the cooler housing 14 during normal use of the bottled water cooler 10. More particularly, to prevent inadvertent separation of the reservoir 12 from the cooler housing 14 during water bottle changeover, or attributable to persons bumping into the cooler, the vessel 24 may be secured to the underlying cooler housing 14 as by a lock ring 54 (FIG. 4) positioned at the base or lower end of the cup-shaped mounting sleeve 40 and defining recessed lock seats 55 for interengagement with lock lugs or tabs 56 projecting radially outwardly from the base or lower end of the chiller element 44. With this structure, the reservoir vessel 24 can be seated upon the chiller element 44, with the lock lugs 56 aligned for reception into the lock seats 55. The reservoir vessel 24 can then be rotated relative to the underlying cooler housing to displace the lock lugs 56 into undercut channels 57 in the lock ring 54, such as by a quarter-turn twist-lock movement, for releasibly securing the vessel 24 to a base end of the chiller element 44. In addition, the lid member 22 is desirably secured to the upper end of the vessel 24, as by a screw-on or snap-fit connection. With this construction, vertically directed forces applied to the vessel 24 during removal of an inverted water bottle 16, by virtue of the reception of the bottle neck 26 into the mounting adapter 28, will not lift the vessel 24 from the underlying cooler housing 14.

However, the removable reservoir 12 is quickly and easily separated from the underlying cooler housing 14 by simple twisting of the reservoir to disengage the lock lugs 56 from the lock ring 54. When these lock lugs are disengaged, the reservoir 12 inclusive of the insulated vessel 24 and lid member 22 can be separated from the housing 14 by simple lift-off removal therefrom. Means such as a kill switch 58 (FIG. 4) are conveniently provided on the upper support wall 46 of the cooler housing 14 to sense reservoir removal and to respond thereto to de-activate the refrigeration unit. The thus-removed reservoir 12 can be transported as a relatively compact portable unit to a site remote from the cooler housing 14, such as, for example, a backyard location, a poolside location, a remote picnic location, etc. At such remote site, the insulated reservoir 12 maintains the refreshing temperature of the water contained therein, and the faucet 34 can be operated normally for remote dispensing of the water or other selected beverage. The water bottle 16 may be installed onto the reservoir 12 at the remote site to replenish the reservoir contents. At the conclusion of such remote usage, the reservoir 12 can be returned to and re-installed on the cooler housing 14 for resumed normal usage. Upon such re-installation, the bottom wall 38 of the vessel 24 engages and depresses the kill switch 58 for resumed operation of the refrigeration unit.

Figure 5:
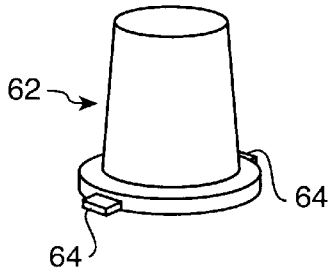
FIG. 5 is a perspective view depicting a portable refrigeration means for use with the removable reservoir, when said reservoir is separated from the cooler housing.

In accordance with one aspect of the invention, the downwardly open mounting sleeve 40 at the bottom of the removable reservoir 12 provides a convenient mounting site for a portable refrigeration source 62, such as a matingly shaped block (FIG. 5) containing a re-usable and freezable packaged chiller media such as that available from Rubbermaid, Inc. of Wooster, Ohio under the trade name Blue Ice. The block 62 may include suitable lugs 64 at a lower or base end thereof for twist-lock engagement with the lock ring 54 on the underside of the vessel 24, for purposes of releasibly locking the block into the mounting sleeve 40. Such portable refrigeration source 62 is, of course, removed from the reservoir 12 prior to re-mounting thereof onto the cooler housing 14.

The improved water cooler 10 of the present invention thus provides a convenient insulated and portable water reservoir which can be used in a normal mode installed onto the cooler housing 14 to provide a chilled water supply, or in an alternative temporary portable mode to provide a chilled water supply at a remote location. Moreover, persons skilled in the art will recognize and appreciate that the removable reservoir may be utilized to contain and dispense other beverages such as tea, juice and other soft drinks in addition to water.

Figure 6:
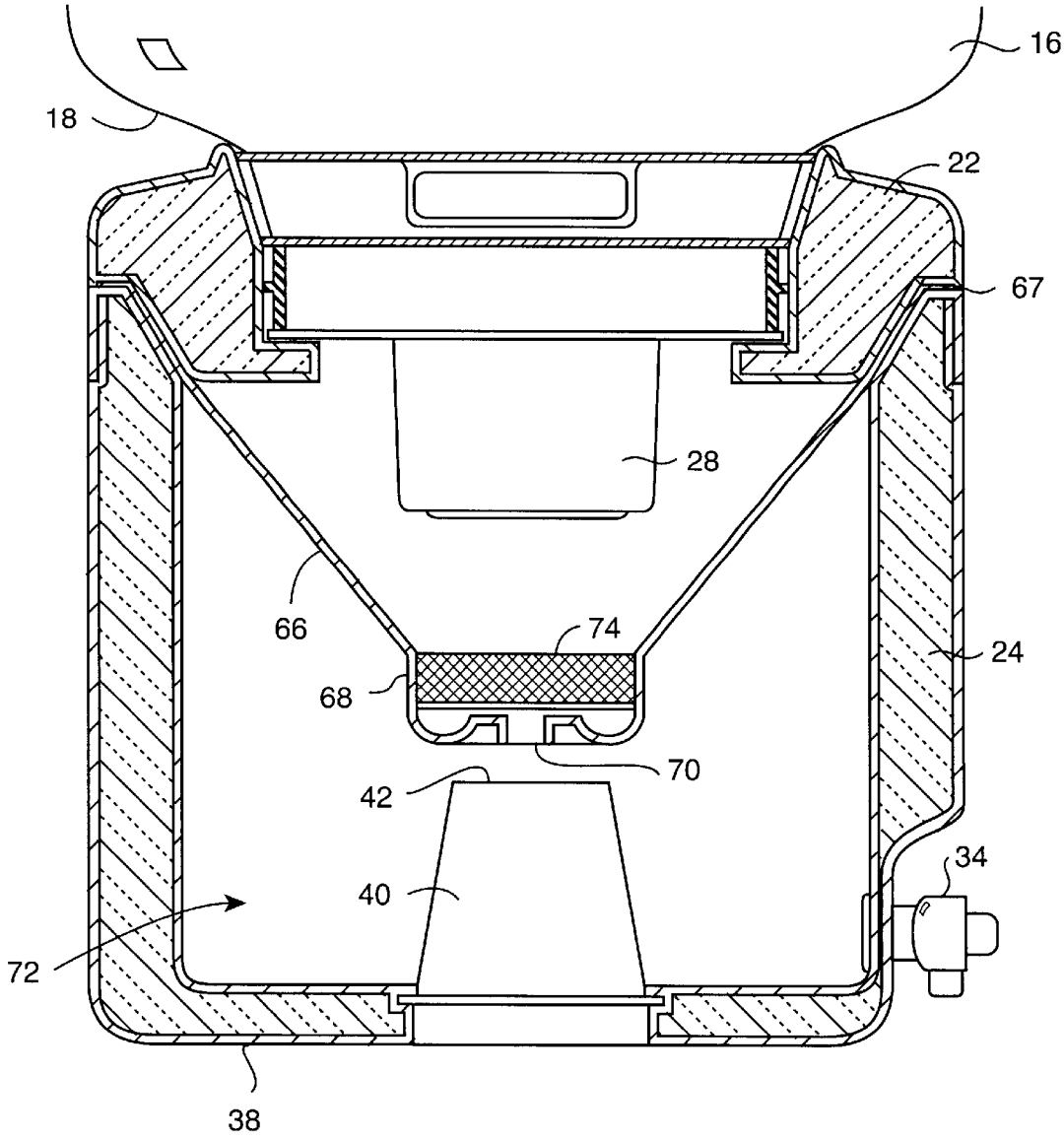
FIG. 6 is an enlarged fragmented sectional view similar to a portion of FIG. 2, but depicting a removable reservoir in an alternative preferred form.

FIG. 6 illustrates one modified removable reservoir configuration, wherein components identical to those shown and described in FIGS. 1–5 are referred to by common reference numerals. The embodiment of FIG. 6 differs from the embodiment of FIGS. 1–5 by inclusion of an inlet funnel 66 having an upper flange 67 captured between the upper rim of the vessel 24 and the periphery of the lid member 22. This inlet funnel 66 is shown to extend downwardly and radially inwardly within the hollow interior of the vessel 24, terminating in a lower or apex end in a generally cylindrical cup 68 defining one or more flow ports 70 for water downflow from the overlying bottle water 16 into a lower chamber 72 of the vessel 24 disposed beneath the inlet funnel 66. A filter cartridge or filter pack 74 including activated carbon or other selected filter media may be seated within the cup 68, immediately above the flow ports 70, for purifying and/or removing contaminants from the water passing downwardly through the flow ports. Such filtered water flows into substantially direct communication with the upper end wall 42 of the underlying mounting sleeve, which is disposed in closely spaced relation thereto, for efficient thermal exchange with the chiller element 44 (not shown in FIG. 6). Accordingly, in this version of the invention, the overlying inverted water bottle 16 may, if desired, contain tap water or the like. The filter pack 74 provides means for purifying this water prior to entry into the lower reservoir chamber 72, and subsequent dispensing therefrom via the faucet 34.

Figure 7:
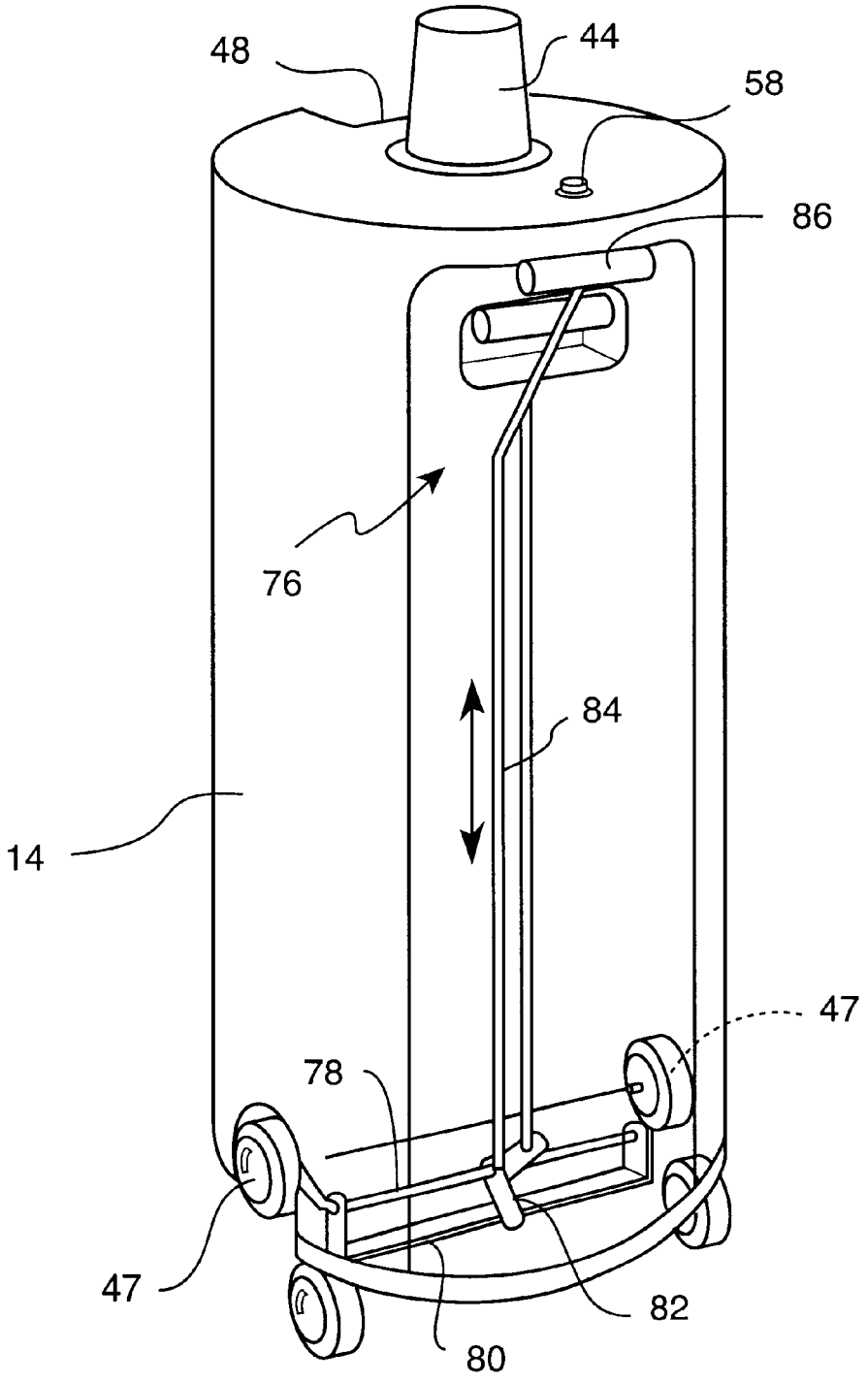
FIG. 7 is a rear perspective view of the cooler housing.

FIG. 7 illustrates a retractable wheel assembly 76 mounted generally along a rear side of the cooler housing 14 for controllably moving the wheels 47 between a normal retracted position (FIGS. 1 and 3) and an extended position (FIG. 7) for facilitated rolling movement of the cooler housing. As shown, the retractable wheel assembly 76 includes a transverse wheel axle 78 supporting the wheels 47 at opposite ends thereof. This wheel axle 78 is carried by the opposite ends of a generally U-shaped pivot bracket 80 which is coupled in turn by a crank link 82 and an upwardly extending push rod 84 to a T-shaped handle 86 exposed near the upper rear end of the cooler housing 14. Manual withdrawal of the handle 86 in a direction rearwardly from the cooler housing is effective to displace the push rod 84 in a manner rotating the crank link 82 and pivot bracket 80 to move the wheels 47 from the normal retracted position (with the cooler housing 14 resting on a floor or the like) to an advanced position permitting easy rolling movement of the cooler housing from one location to another. Manual advancement of the handle 86 back toward the cooler housing is effective to reverse this movement and return the wheels 47 to the normal retracted position.

Figure 8:
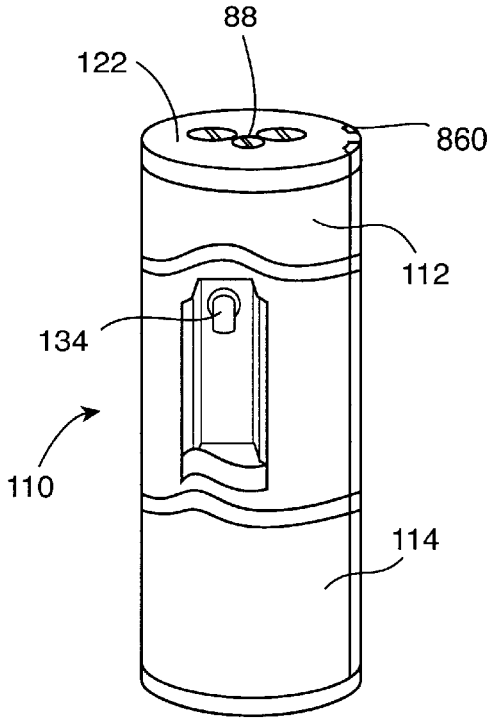
FIG. 8 is a perspective view of another alternative preferred form of the invention, including a removable reservoir mounted onto the upper end of an underlying cooler housing.
Figure 9:
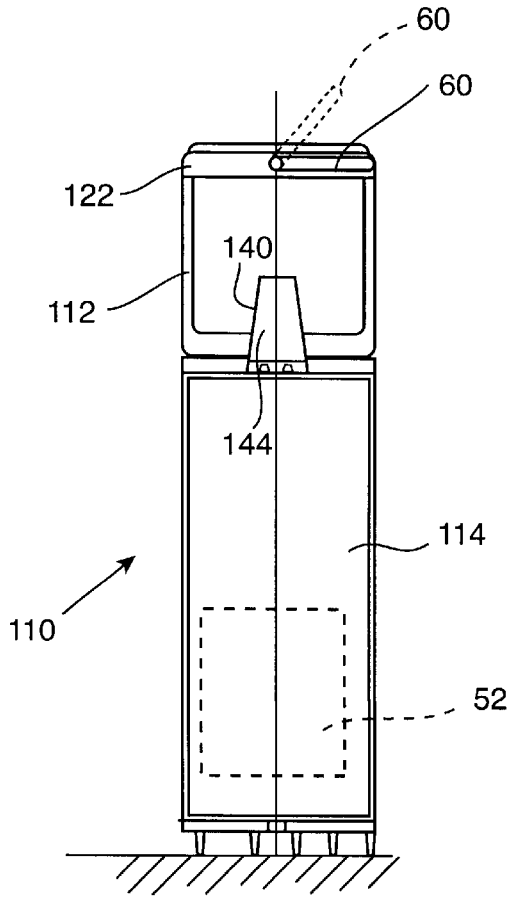
FIG. 9 is a fragmented sectional view of the embodiment of FIG. 8.
Figure 10:
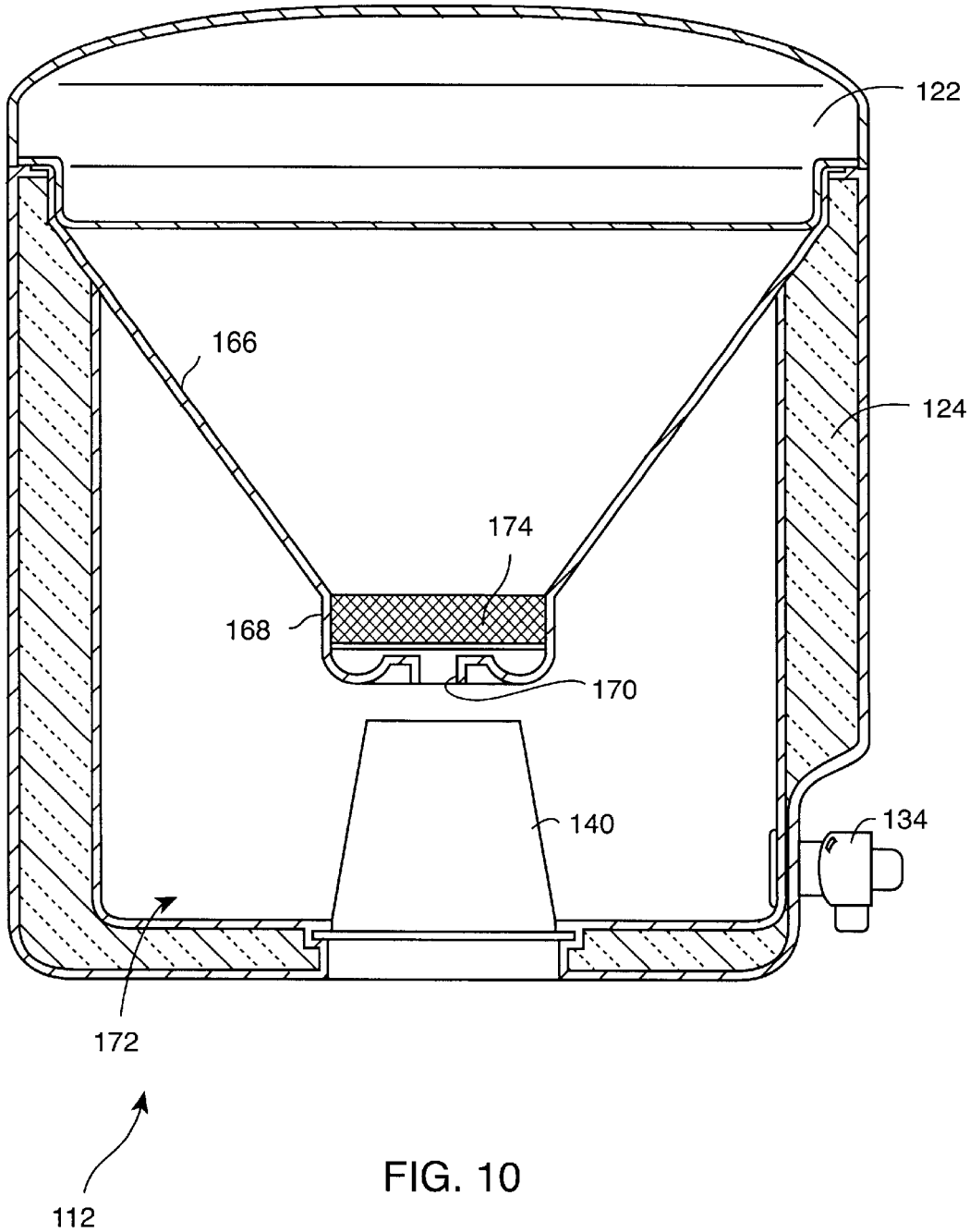
FIG. 10 is an enlarged fragmented sectional view showing a further alternative form of the removable reservoir.

FIGS. 8–10 illustrate another alternative preferred embodiment of the invention, wherein components corresponding to those shown and described in FIGS. 1–5 are identified by common reference numerals increased by 100. As shown, a modified water cooler 110 (FIGS. 8–9) includes a removable reservoir 112 for quick and easy separation from an underlying cooler housing 114, wherein the water cooler 110 in this embodiment is not designed to support an inverted water bottle as the water supply source.

More particularly, the removable reservoir 112 shown in FIGS. 8–10 includes a modified insulated lid member 122 having a generally circular size and shape for screw-on or snap-fit mounting to cover and close the upper end of the insulated vessel 124. Water is added on a periodic or as-needed basis to the vessel 124 by removing the lid member 122 and pouring water obtained from a tap or bottled water source into the vessel. Water is dispensed from the vessel via the faucet 134. A one-way check valve 88 is provided in the lid member 122 to permit air inflow into the reservoir upon water dispensing, but to prevent water leakage to the exterior. A refrigeration unit 52 is shown mounted within the lower cooler housing 114 for regulating the temperature of a chiller element 144 seated into the mounting sleeve 140 at the underside of the insulated vessel 124. Importantly, the removable reservoir 112 shown in FIGS. 8–9 includes a carrying handle 60 and is separable from the underlying cooler housing i 114 for portable remote use, in the same manner as previously described with respect to. the embodiment of FIGS. 1–5.

FIG. 10 shows the insulated reservoir 112 to include the lid member 122 cooperating with the vessel 124 to capture and retain an inlet funnel 166 similar to the one shown and described in FIG. 6. The inlet funnel 166 extends downwardly and radially inwardly from the upper rim of the vessel 124, terminating in a central cup 168 defining one or more flow ports 170 leading downwardly to a lower vessel chamber 172. A filter cartridge or filter pack 174 is mounted in the cup 168 to filter and purify water passing downwardly through the flow ports 170, and thereby purifies tap water or the like poured into the vessel 124. With this design, water dispensed via the faucet 134 passes first through the filter pack 174 for purification.

Figure 11:
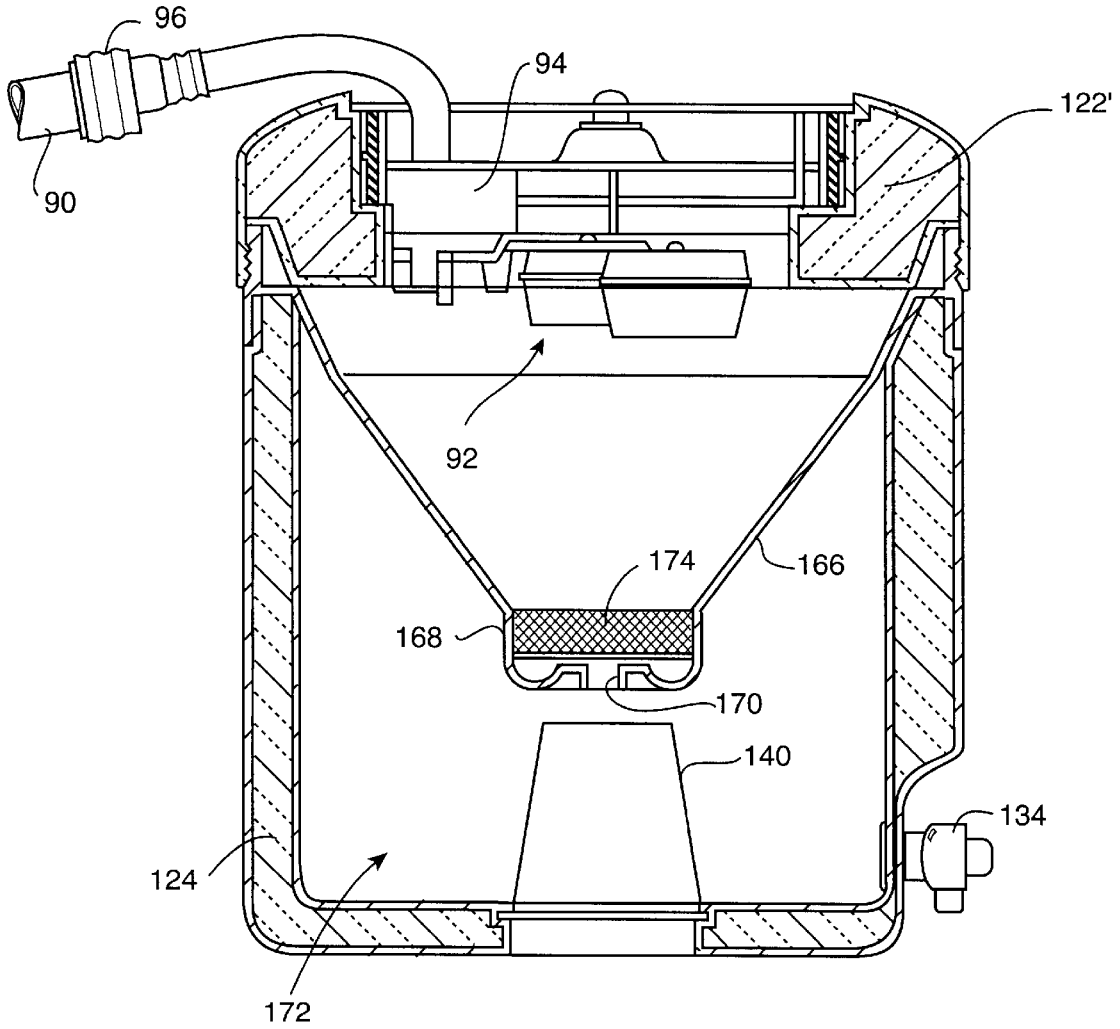
FIG. 11 is an enlarged fragmented sectional view similar to FIG. 10, and showing still another alternative preferred form for the removable reservoir.

FIG. 11 depicts a further alternative form of the removable reservoir of FIGS. 8–10, wherein an alternative modified lid member 122' is coupled to a water supply line 90, such as a tap water supply line for providing water inflow to the vessel 124. A float valve assembly 92 is mounted at the underside of the lid member 122' and functions to operate a valve unit 94 mounted along the supply line 90, for purposes of regulating water inflow to the reservoir interior. The construction and operation of this float assembly and associated valve unit corresponds, in a preferred form, with the float assembly disclosed and described in U.S. Pat. No. 6,062,255, which is incorporated by reference herein. The water supply line 90 conveniently includes a quick-connect-disconnect fitting 96 to accommodate reservoir removal and separation from the cooler housing for temporary usage at a remote location.

Figure 12:
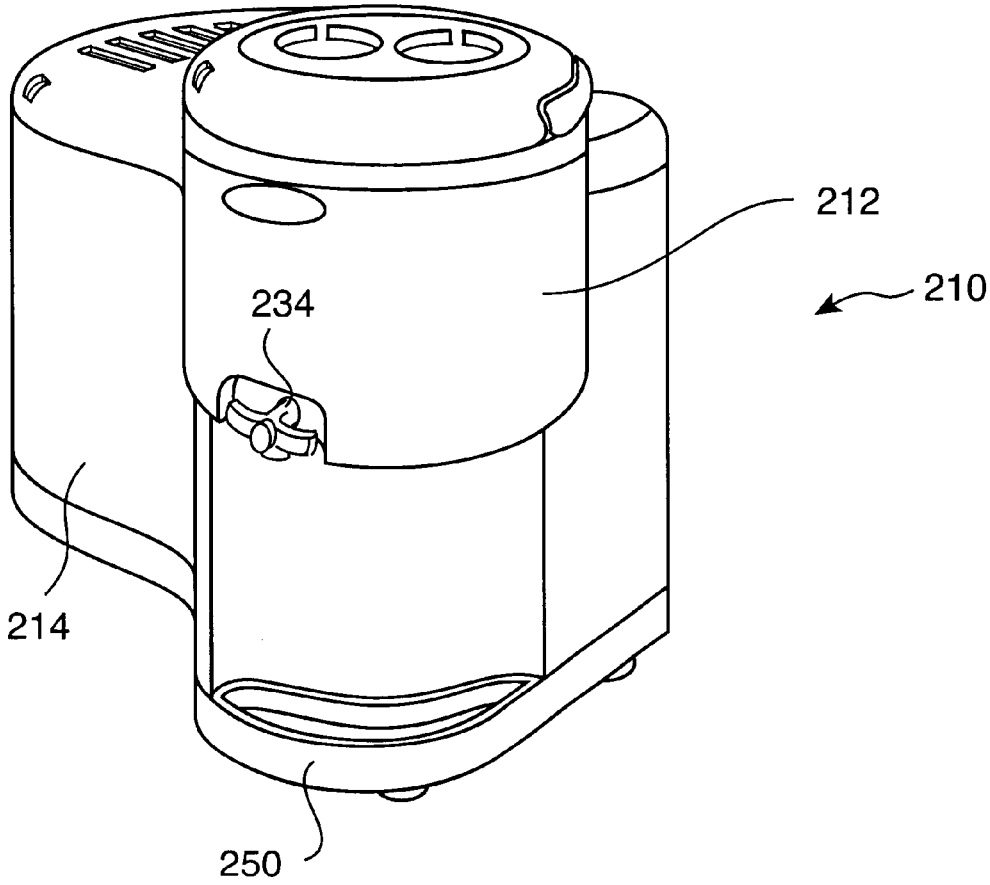
FIG. 12 is a perspective view a countertop version of the removable reservoir cooler of the present invention.

FIG. 12 shows a further alternative preferred form of the invention, wherein components corresponding to those shown and described in FIGS. 1–5 are identified by common reference numerals increased by 200. As shown, a modified water cooler 210 is provided in a compact countertop configuration. In this embodiment, a removable reservoir 212 is modified in size and shape for removable mounting onto a compact housing base 214 sized for countertop installation and including a drip tray 250 mounted in alignment below a reservoir faucet 234. The reservoir 212 is designed for quick and easy separation from the housing base 214 in the same manner as described previously with respect to FIGS. 1–5.

Figure 13:
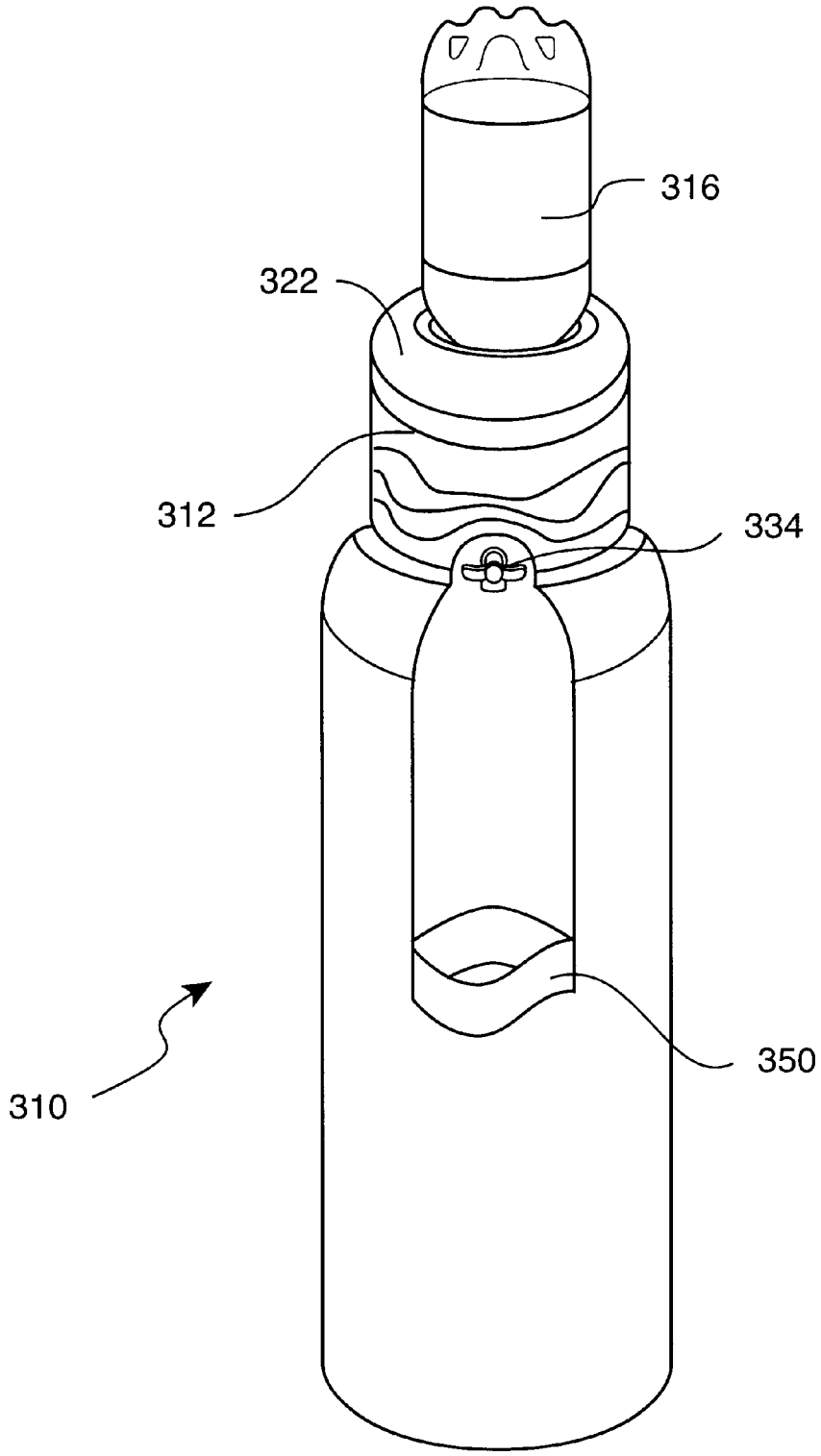
FIG. 13 is a perspective view of still another alternative preferred form of the invention.

FIG. 13 shows another alternate bottled water cooler, with components corresponding to those shown and described in FIGS. 1–5 are identified by common reference numerals increased by 300. As illustrated, a modified bottled water cooler 310 is provided similar to the embodiment of FIGS. 1–5, except that a lid member 322 for a removable reservoir 312 is designed to accommodate a water bottle 316 of different size, such as a smaller water bottle of two-liter size or the like. The cooler 310 is otherwise similar in construction and operation, to include a dispensing faucet 334 positioned over a drip tray 350 when the reservoir 312 is properly mounted onto the cooler housing 312.

A variety of further modifications and improvements in and to the removable reservoir cooler of the present invention will be apparent to persons skilled in the art. For example, it will be recognized and understood that the lid member 22 (FIGS. 1, 2 and 6) having the central opening therein may be replaced during portable use of the removable reservoir 12 by a lid member 122 lacking a central opening, as viewed in FIGS. 8–9, in the event all that use of an inverted water bottle 16 on the reservoir 12 is not required or desired at the remote site of use. Moreover, it will be appreciated that the En cooler 10 may be used for receiving and storing a wide range of beverages other than water.

Accordingly, no limitation on the invention is intended byway of the foregoing description and accompanying drawings, except as set forth in the appended claims.

What is claimed is:

1. A water cooler, comprising:

a cooler housing;

a reservoir defining an internal chamber for receiving and storing a supply of water, and further including at least one faucet mounted thereon for dispensing water therefrom;

means for removably mounting said reservoir onto said cooler housing;

refrigeration means on said cooler housing for chilling water within said reservoir when said reservoir is mounted onto said cooler housing;

said reservoir with said at least one faucet mounted thereon being separable from said cooler housing for transport to and dispensing of water therefrom at a site remote from said cooler housing; and further including means responsive to separation of said reservoir from said cooler housing for deactivating said refrigeration means.

2. The water cooler of claim 1 further including lock means for releasibly locking said reservoir onto said cooler housing.

3. The water cooler of claim 1 wherein said means for removably mounting said reservoir onto said cooler housing accommodates lift-off separation of said reservoir with said at least one faucet mounted thereon from said cooler housing.

4. The water cooler of claim 1 wherein said means for deactivating said frigeration means comprises a kill switch mounted on said cooler housing in a position for engagement by said reservoir when said reservoir is mounted onto said cooler housing.

5. The water cooler of claim 1 wherein said reservoir comprises an insulated, vessel.

6. The water cooler of claim 1 wherein said cooler housing defines a generally upwardly presented support wall for removably supporting said reservoir, and further wherein said reservoir defines a bottom wall for rested support upon said support wall when said reservoir is mounted onto said cooler housing, said reservoir having external walls with a size and shape conforming to the external configuration of said cooler housing.

7. The water cooler of claim 1 wherein said reservoir has a bottom wall defining a downwardly open and generally inverted cup-shaped mounting sleeve, and wherein said refrigeration means comprises a generally cup-shaped chiller probe extending upwardly from said cooler housing and having a size and shape for substantially mated fit into said mounting sleeve when said reservoir is mounted onto said cooler housing.

8. The cooler of claim 7 wherein said chiller pro be extends upwardly from a generally horizontally oriented support wall defined by said cooler housing for supporting said reservoir, and further wherein said means for deactivating said refrigeration means comprises a kill switch mounted on said support wall for engagement by said reservoir when said reservoir is mounted onto said cooler housing.

9. The water cooler of claim 7 further including a portable refrigeration element for removable mounting within said mounting sleeve when said reservoir is separated from said cooler housing.

10. The water cooler of claim 9 wherein said portable refrigeration element comprises a block filled with a freezable chiller media.

11. The water cooler of claim 1 wherein said reservoir further includes a lid portion having a central opening formed therein, and including means for removably supporting a water bottle in an inverted position for supplying water to said internal chamber.

12. The water cooler of claim 11 further including filter means for purifying water supplied from a water bottle to said internal chamber.

13. The water cooler of claim 1 wherein said reservoir further includes a lid member, said lid member being removable to permit water to be added to said internal chamber.

14. The water cooler of claim 1 further including means for connecting said reservoir to a supply of substantially purified water.

15. The water cooler of claim 2 wherein said lock means comprises interengageable lock lugs and lock seats formed on said reservoir and said cooler housing for releasibly retaining said reservoir on said cooler housing.

16. The water cooler of claim 2 wherein said lock means comprises part-turn fastener means for releasibly retaining said reservoir on said cooler housing.

17. A water cooler, comprising:

an insulated reservoir defining an internal chamber for receiving and storing a supply of water, said reservoir having a bottom wall defining a downwardly open and generally inverted cup-shaped mounting sleeve, and said reservoir further including at least one faucet mounted thereon for dispensing water therefrom;

a cooler housing defining a generally upwardly presented support wall for removably supporting said insulated reservoir;

means for removably mounting and releasibly locking said insulated reservoir in a position mounted onto said cooler housing, with said bottom wall of said reservoir rested upon said support wall of said cooler housing;

refrigeration means including a refrigeration probe extending upwardly from said support wall and having a size and shape for substantially mated fit into said mounting sleeve when said reservoir is mounted onto said cooler housing, said refrigeration probe being in thermal communication through said mounting sleeve with water within said reservoir for chilling water within said reservoir when said reservoir is mounted onto said cooler housing;

said insulated reservoir being removable from said cooler housing by lift-off separation therefrom for transport to and dispensing of water therefrom at a site remote from said cooler housing; and further including means responsive to separation of said reservoir from said cooler housing for deactivating said refrigeration means.

18. The water cooler of claim 17 wherein said means for deactivating said refrigeration means comprises a kill switch mounted on said cooler housing support wall in a position for engagement by said reservoir bottom wall when said reservoir is mounted onto said cooler housing.

19. The water cooler of claim 17 wherein said cooler housing and said insulated reservoir include external walls having a conforming size and shape.

20. The water cooler of claim 17 further including a portable refrigeration element for removable mounting within said mounting sleeve when said reservoir is separated from said cooler housing.

21. The water cooler of claim 20 wherein said portable refrigeration element comprises a block filled with a freezable chiller media.

22. The water cooler of claim 21 wherein said reservoir and said block include interengageable lock means for releasibly retaining said block within said mounting sleeve.

23. The water cooler of claim 17 wherein said reservoir further includes a lid portion having a central opening formed therein, and including means for removably supporting a water bottle in an inverted position for supplying water to said internal chamber.

24. The water cooler of claim 23 further including filter means for purifying water supplied from a water bottle to said internal chamber.

25. The water cooler of claim 17 wherein said reservoir further includes a lid member, said lid member being removable to permit water to be added to said internal chamber.

26. The water cooler of claim 17 further including means for connecting said reservoir to a supply of substantially purified water.

27. The water cooler of claim 17 wherein said mounting and locking means includes interengageable lock lugs and lock seats formed on said reservoir and said cooler housing for releasibly retaining said reservoir on said cooler housing.

28. The water cooler of claim 27 wherein said interengageable lock lugs and lock seats comprise a lock ring formed generally at an open end of said mounting sleeve and defining a plurality of recessed lock seats, and a plurality of lock tabs formed generally at a lower end of said probe for seated engagement with said lock seats.

29. The water cooler of claim 28 further including a portable refrigeration element for removable mounting within said mounting sleeve when said reservoir is separated from said cooler housing, said portable refrigeration element including a plurality of lock tabs for seated engagement with said lock seats for releasibly retaining said portable refrigeration element within said mounting sleeve.

30. The water cooler of claim 17 wherein said mounting and locking means includes part-turn fastener means for releasibly retaining said reservoir on said cooler housing.

31. A water cooler, comprising:

a cooler housing;

a reservoir defining an internal chamber for receiving and storing a supply of water;

means for mounting said reservoir onto said cooler housing;

at least one faucet for dispensing water from said reservoir;

refrigeration means for chilling water within said reservoir when said reservoir is mounted onto said cooler housing; and a retractable wheel assembly mounted on said cooler housing, said retractable wheel assembly including at least one rotatable wheel, and retractable linkage means for moving said wheel between an advanced position in rolling engagement with a floor surface for facilitated rolling transport of said cooler housing, and a retracted position substantially out of rolling engagement with the floor surface.

* * * * *